US007207868B2

(12) United States Patent
Takehara et al.

(10) Patent No.: US 7,207,868 B2
(45) Date of Patent: Apr. 24, 2007

(54) CUTTING APPARATUS

(75) Inventors: Masataka Takehara, Kyoto (JP); Masaharu Yoshida, Kyoto (JP); Yasuyuki Kitagawa, Kyoto (JP); Kazuyuki Kishimoto, Kyoto (JP); Kiyoharu Kato, Kyoto (JP)

(73) Assignee: Towa Corporation, Kyoto-shi (JP)

( * ) Notice: Subject to any disclaimer, the term of this patent is extended or adjusted under 35 U.S.C. 154(b) by 0 days.

(21) Appl. No.: 11/522,447

(22) Filed: Sep. 18, 2006

(65) Prior Publication Data

US 2007/0066190 A1 Mar. 22, 2007

(30) Foreign Application Priority Data

Sep. 22, 2005 (JP) ..... 2005-276904

(51) Int. Cl.
*B24B 1/00* (2006.01)

(52) U.S. Cl. ..... 451/75; 451/2; 451/388; 451/411; 451/412

(58) Field of Classification Search ..... 451/411, 451/412, 388, 2, 41, 75, 76
See application file for complete search history.

(56) References Cited

U.S. PATENT DOCUMENTS 3,652,075 A * 3/1972 Thompson ..... 269/21
5,572,786 A * 11/1996 Rensch ..... 29/559
5,626,508 A * 5/1997 Rankin et al. ..... 451/102
6,601,783 B2 * 8/2003 Chisum et al. ..... 239/433
6,672,576 B1 * 1/2004 Walker ..... 269/21
6,852,002 B2 * 2/2005 Stewart et al. ..... 451/2
2003/0092364 A1 * 5/2003 Erickson et al. ..... 451/75

FOREIGN PATENT DOCUMENTS

JP 2000-767 A 1/2000
JP 2004-130399 A 4/2004
JP 2004-130400 A 4/2004
JP 2004-130401 A 4/2004

* cited by examiner

*Primary Examiner*—Lee D. Wilson
*Assistant Examiner*—Anthony Ojini
(74) *Attorney, Agent, or Firm*—Birch, Stewart, Kolasch & Birch, LLP

(57) ABSTRACT

A cutting apparatus jets, at a high pressure, water containing abrasive grains to cut a workpiece along cutting lines extending in intersecting directions. The cutting apparatus includes: a fixing table fixing the workpiece; groove portions provided in the fixing table at respective positions below the cutting lines; protruded portions provided in regions of the fixing table other than regions where the groove portions are provided, in a manner that the workpiece contacts the protruded portions; support portions provided to connect the protruded portions substantially in parallel with cutting lines extending the Y direction along the groove portions; a frame portion provided to connect the support portions to each other in at least a part of an outer periphery of the fixing table; and protection members attachably and detachably provided to cover the support portions. Thus, in the case where the workpiece is cut along the intersecting cutting lines, replacement of the fixing table fixing the workpiece is unnecessary and wear of the fixing table is prevented.

3 Claims, 8 Drawing Sheets

CUTTING APPARATUS

This nonprovisional application is based on Japanese Patent Application No. 2005-276904 filed with the Japan Patent Office on Sep. 22, 2005, the entire contents of which are hereby incorporated by reference.

BACKGROUND OF THE INVENTION

1. Field of the Invention

The present invention relates to a cutting apparatus using water containing abrasive grains.

2. Description of the Background Art

A description is given of conventional cutting apparatus and cutting method using water containing abrasive grains. This method was invented for the purpose of improving machining efficiency of a method of cutting a workpiece by jetting high-pressure water to the workpiece (so-called waterjet cutting) (for example, Japanese Patent Laying-Open No. 2000-000767, pages 2–4, FIGS. 1–4). The method uses, as an abrasive (abrasive grains), garnet, silica sand or cast steel grit for example. The abrasive in wet state is supplied from an abrasive tank via an abrasive supply pipe and, from an abrasive supply inlet, into a mixing chamber of an abrasive nozzle head. Here, the wet abrasive is fed (pressure-fed) into the mixing chamber by high-pressure air generated by a compressor. In the mixing chamber, the abrasive is mixed with a high-pressure waterjet and the resultant abrasive waterjet containing the abrasive is emitted from an abrasive nozzle. The abrasive waterjet having been used for cutting is passed through grooves in a table (fixing table) which supports a work (material to be cut) and thereafter collected by a catcher (see Japanese Patent Laying-Open No. 2000-000767, pp. 2–4, particularly FIG. 4 of FIGS. 1–4). The abrasive is collected by a sieve and the collected abrasive still in the wet state is returned as it is to the abrasive tank for reuse (see Japanese Patent Laying-Open No. 2000-000767, pp. 2–4, particularly FIG. 1 of FIGS. 1 to 4).

In recent years, the above-described cutting method using water containing abrasive grains has also been applied to the case where an encapsulated body in which chip-like components (semiconductor chips and the like) mounted on a circuit board are encapsulated all together in resin is cut along cutting lines intersecting at right angles in a grid pattern. In this case, high-precision cutting positions and a cutting width of approximately 200 μm are required.

However, according to the conventional technique, in the case where an encapsulated body as described above is cut, it is necessary to replace, after cutting the encapsulated body along cutting lines in one direction, the original table having grooves with a new table having grooves extending in a direction different from that of the grooves of the original table by 90°. It is further necessary to align the encapsulated body with respect to the new table for setting it again on the table and thereafter cut the encapsulated body along cutting lines in another direction. A reason for performing these operations is that, for the purpose of avoiding wear of the table (fixing table) supporting the work (encapsulated body to be cut), it is necessary to allow an abrasive waterjet to pass through the grooves provided in the table (see Japanese Patent Laying-Open No. 2000-000767, pp. 2–4, Table 14 in FIG. 4 of FIGS. 1–4). Accordingly, the abrasive waterjet having been used for cutting the work (encapsulated body) supported on the new table is passed through the grooves and thereafter collected by the catcher without contacting the new table. This technique requires two tables and thus the cost for the apparatus is increased. Further, since it is necessary to align the encapsulated body with respect to the new table for setting it again on the new table, working efficiency is reduced. Furthermore, the dimensional accuracy (such as position and angle) in cutting could be deteriorated.

SUMMARY OF THE INVENTION

An object of the present invention is to provide a cutting apparatus that cuts a workpiece along cutting lines intersecting at right angles in a grid pattern, that does not require replacement of a fixing table fixing the workpiece and thus does not require alignment of the workpiece with respect to a new fixing table for re-setting the workpiece on the new fixing table, and that can prevent increase in cost for the apparatus, reduction in working efficiency and deterioration in dimensional accuracy in cutting.

With the purpose of achieving the above-described object, a cutting apparatus according to the present invention is a cutting apparatus jetting, at a high pressure, water containing abrasive grains from a nozzle so as to cut a workpiece along cutting lines extending in two intersecting directions. The cutting apparatus includes: a fixing table fixing the workpiece; groove portions provided in the fixing table at respective positions below the cutting lines; protruded portions provided in respective regions of the fixing table other than regions where the groove portions are provided, in a manner that the workpiece contacts the protruded portions; support portions provided to connect the protruded portions substantially in parallel with a cutting line extending in at least one of the two directions along the groove portions; a frame portion provided to connect the support portions to each other in at least a part of an outer periphery of the fixing table; and protection members attachably and detachably provided to cover the support portions. The protection members are provided to allow the water containing abrasive grains to impinge against the protection members and thereby prevent the water containing abrasive grains from impinging against the support portions.

In the cutting apparatus according to the present invention, the protection members may be made of a material higher in hardness than the abrasive grains.

The cutting apparatus according to the present invention further includes a wall member provided at the outer periphery of the fixing table for the purpose of preventing scattering of the water containing abrasive grains. The wall member may be attachable to and detachable from the fixing table and the protection members may be inserted to the groove portions in a state where the wall member is detached.

According to the present invention, since the protection members are attachably and detachably provided to cover the support portions, the encapsulated body is cut without impingement of the water containing abrasive grains against the support portions. Accordingly, without wear of the fixing table, the encapsulated body is cut in two intersecting directions by means of the same fixing table. In other words, in the case where the encapsulated body is cut in two intersecting directions, it is unnecessary to prepare two types of fixing tables, to replace the fixing table and to align the encapsulated body. Therefore, in the case where the encapsulated body is cut along cutting lines in two intersecting directions, the cost for the fixing table is reduced and reduction in working efficiency and deterioration in dimensional accuracy (such as position and angle) in cutting are prevented.

Further, since the protection members are made of a material higher in hardness than the abrasive grains, wear of the fixing table is prevented and the lifetime of the protection members is extended.

Furthermore, the wall member is attachably and detachably provided at the outer periphery of the fixing table and, in the state where the wall member is detached, the protection members are inserted into the grooves. Accordingly, the processing of the fixing table as a whole including the wall member is facilitated and thus the fixing table can be reduced in price. In addition, such operations as inserting and fitting for example the protection members in the groove portions are facilitated.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
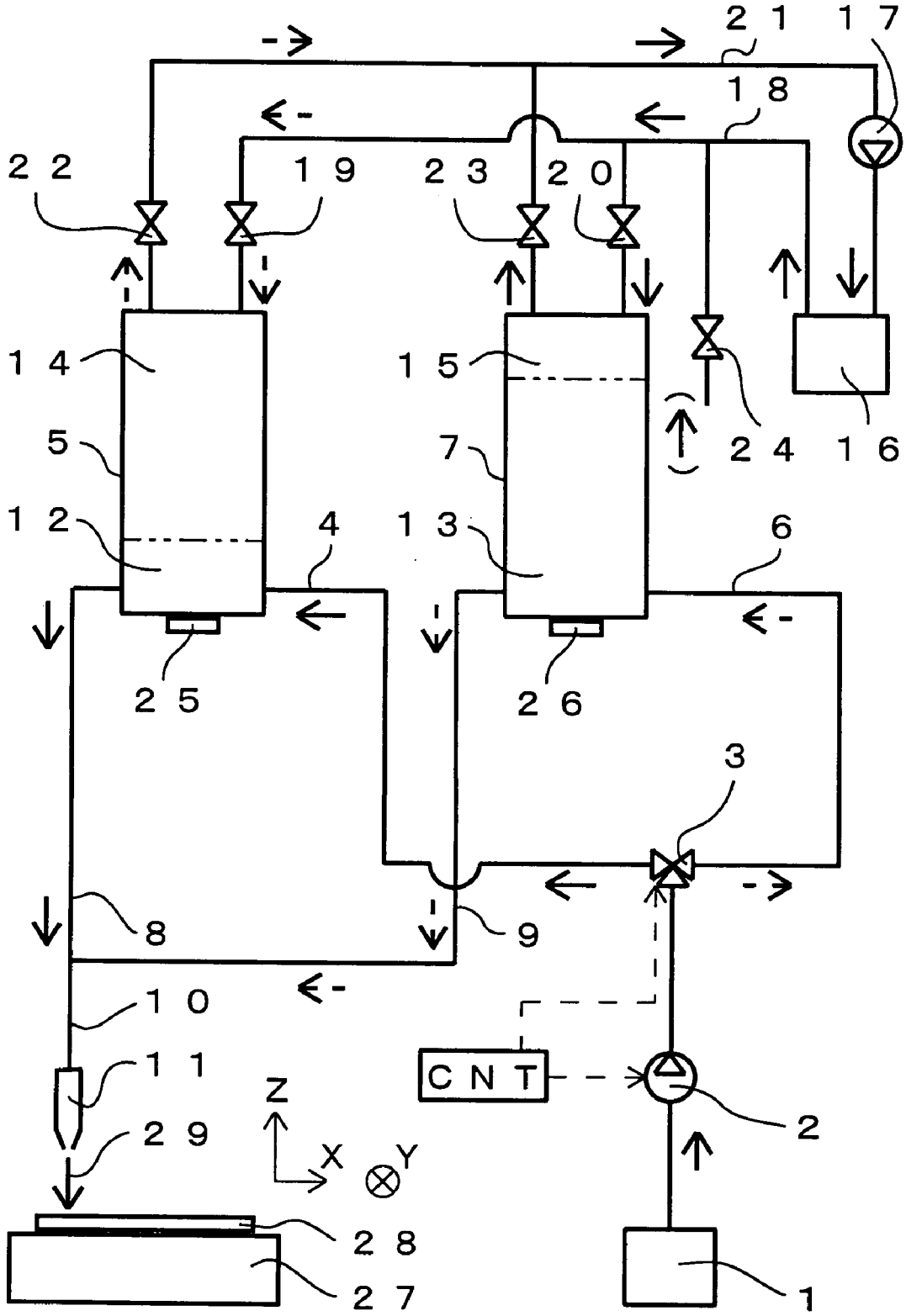
FIGS. 1 to 4 are respective diagrams of pipe systems, schematically showing respective structures of cutting apparatuses according to first to fourth embodiments of the present invention, respectively.

In the following, a cutting apparatus of an embodiment is described with reference to the drawings.

The cutting apparatus jets, at a high pressure, water containing abrasive grains from a nozzle (11) so as to cut a workpiece (28) along cutting lines (63, 64) extending in two intersecting directions. The cutting apparatus includes: a fixing table (66) fixing the workpiece (28); groove portions (68X, 68Y) provided in the fixing table (66) at respective positions below the cutting lines; protruded portions (67) provided in regions of the fixing table (66) other than regions where the groove portions (68X, 68Y) are provided, in a manner that the workpiece (28) contacts the protruded portions; support portions (69) provided to connect the protruded portions (67) substantially in parallel with a cutting line (64) extending in at least one of the two directions along the groove portions (68X, 68Y); a frame portion (70) provided to connect the support portions (69) to each other in at least a part of the outer periphery of the fixing table (66); and protection members (74) attachably and detachably provided to cover the support portions (69). The protection members (74) are provided for the purpose of allowing the water containing abrasive grains to impinge against the protection members (74) and thereby preventing the water containing abrasive grains from impinging against the support portions (69). The protection members (74) are made of a material higher in hardness than the abrasive grains. The cutting apparatus further includes a wall member (77) provided at the outer periphery of the fixing table (66) for the purpose of preventing the water containing abrasive grains from scattering. The wall member (77) is attachable to and detachable from the fixing table (66). Thus, in the state where the wall member (77) is detached, the protection members (74) are inserted into the grooves (68X, 68Y).

First Embodiment

A first embodiment of the cutting apparatus according to the present invention is described with reference to FIG. 1. FIG. 1 is a diagram of a pipe system, schematically showing a structure of the cutting apparatus according to the present embodiment. It is noted that any drawing referred to in the following description is schematically shown in which some parts are not shown or some parts are emphasized where appropriate for the sake of easy understanding. Moreover, in connection with the following embodiments each, a description is given of a case where an encapsulated body in which semiconductor chips or the like mounted on a circuit board are encapsulated all together in resin is cut along grid-pattern cutting lines intersecting at right angles. In this case, a highly accurate cutting position as well as a cutting width of approximately 200 μm are required.

The cutting apparatus shown in FIG. 1 has a system of jetting water containing abrasive grains at a high pressure, and the system has components as described below. The components include a high-pressure pump 2 increasing the pressure of water supplied from a water source 1, a switch valve 3 connected to high-pressure pump 2, a first tank 5 connected to switch valve 3 via a first inlet-side water pipe 4, and a second tank 7 connected to switch valve 3 via a second inlet-side water pipe 6. The components further include a first outlet-side water pipe 8 connected to the first tank 5 and a second outlet-side water pipe 9 connected to the second tank 7. Furthermore, the components include a nozzle pipe 10 connected to a portion where the first outlet-side water pipe 8 and the second outlet-side water pipe 9 are connected, and a nozzle 11 for cutting that is connected to nozzle pipe 10. The first tank 5 and the second tank 7 are substantially filled with water containing abrasive grains.

Here, the abrasive grains are made of such a material as silicon carbide (SiC), alumina ($Al_2O_3$) or garnet and have a grain diameter d of approximately 10 to 100 μm. The grains have a specific gravity larger than 1. Therefore, in a normal state, the first tank 5 and the second tank 7 respectively include high-ratio portions 12 and 13 in which the abrasive grains precipitate and accordingly the ratio of the abrasive grains is high as well as low-ratio portions 14 and 15 in which water occupies almost the entire content. "Ratio" herein means "ratio of abrasive grains in water containing the abrasive grains to the water containing the abrasive grains" (the meaning is the same hereinafter). Further, the fact that the first and second tanks 5, 7 are each "substantially filled" with water containing abrasive grains means any case including the case where a few air bubbles or spaces remain in the tank (the meaning is the same hereinafter). Furthermore, since switch is made between the first tank 5 and the second tank 7 to be used, preferably the first tank 5 and the second tank 7 have the same capacity.

The cutting apparatus shown in FIG. 1 includes a system of supplying abrasive grains to the first tank 5 and the second tank 7 and the system includes components as described below. The components include an abrasive tank 16 storing water in which the ratio of abrasive grains is high (hereinafter referred to as "high-ratio water") and an extrusion pump 17 that supplies pressurized water to abrasive tank 16 and thereby extrudes the high-ratio water from abrasive tank 16. The components further include an abrasive supply pipe 18 supplying the high-ratio water extruded from abrasive tank 16 to the first tank 5 and the second tank 7, a first abrasive supply valve 19 provided at a portion of abrasive supply pipe 18 that leads to the first tank 5, and a second abrasive supply valve 20 provided at a portion of abrasive supply pipe 18 that leads to the second tank 7. Furthermore, the components include a return pipe 21 returning, in the case where the high-ratio water is supplied, water overflowing from the first tank 5 and the second tank 7 back into abrasive tank 16, a first return valve 22 provided at a portion of return pipe 21 that leads to the first tank 5, and a second return valve 23 provided at a portion of return pipe 21 that leads to the second tank 7. In this system, a water supply valve 24 for supplying water from the outside to abrasive supply pipe 18 is provided. By the function of the system as described above of supplying abrasive grains to the first and second tanks 5, 7, the first and second tanks 5, 7 are substantially filled with water containing abrasive grains all the time.

Further, the cutting apparatus shown in FIG. 1 includes a system of appropriately keeping the ratio of abrasive grains in the first tank 5 and the second tank 7, and the system has the following components. The components include a first sensor 25 and a second sensor 26 fixed to respective bottom portions of the first tank 5 and the second tank 7 and comprised respectively of load cells. Further, in this system, a control unit (controller) CNT is provided that receives signals from the first and second sensors 25, 26 and calculates respective weights of the water containing abrasive grains in the first and second tanks 5, 7 based on the signals to control such components as valves and pumps of the cutting apparatus as required. In FIG. 1, lines used by control unit CNT for controlling high-pressure pump 2 and switch valve 3 are virtually shown by the broken lines while other lines are not shown.

The cutting apparatus shown in FIG. 1 further includes a moving mechanism (not shown) moving nozzle 11 in the horizontal (XY) direction and the vertical (Z) direction as well as a fixing table 27. Fixing table 27 is described hereinlater. On fixing table 27, an encapsulated body 28 that is a workpiece to be cut is fixed by such a method as sucking. The water containing abrasive grains is jetted at a high pressure from nozzle 11, and high-pressure water 29 that is the jetted water and contains the abrasive grains is used to cut encapsulated body 28.

In the following, a description is given of a method of cutting encapsulated body 28 that is a workpiece to be cut, by means of the cutting apparatus in FIG. 1. Firstly, an operation is described of substantially filling the first and second tanks 5, 7 with water containing abrasive grains.

To the first tank 5 and the second tank 7, water containing abrasive grains is supplied. Accordingly, the first and second tanks 5, 7 are substantially filled with the water containing abrasive grains. The operation is specifically as follows. In order to supply the water containing abrasive grains to the first tank 5, the first return valve 22, the first abrasive supply valve 19 and water supply valve 24 are opened while the second abrasive supply valve 20 and the second return valve 23 are closed. Then, water is supplied at a predetermined pressure to the first tank 5 via water supply valve 24, abrasive supply pipe 18 and the first abrasive supply valve 19 successively. A resultant negative pressure causes the high-ratio water to be sucked out from abrasive tank 16. The high-ratio water as sucked out is injected, together with the water, into the first tank 5 via abrasive supply pipe 18 and the first abrasive supply valve 19 successively. When the first tank 5 has been filled with the water containing abrasive grains, water supply valve 24, the first abrasive supply valve 19 and the first return valve 22 are closed, Through a procedure similar to the above-described one, the second tank 7 can substantially be filled with the water containing abrasive grains.

Here, preferably the original ratio of abrasive grains to the water containing the abrasive grains that fills the first and second tanks 5, 7 each is at least 50% by volume and at most 70% by volume for the following reason. A higher ratio provides a higher cutting efficiency and is thus preferable, while a ratio higher than 70% by volume makes it difficult to uniformly distribute abrasive grains within the tank. The original ratio of abrasive grains to the water containing the abrasive grains that fills the first and second tanks 5, 7 each is determined by such factors as the ratio of abrasive grains to the high-ratio water, and the pressure and quantity of water injected via water supply valve 24. If the above-described ratio in the tank exceeds the above-described standard (70% by volume for example) for some reason, water may be supplied to the tank by opening water supply valve 24.

Secondly, with reference to FIG. 1, a description is given of an operation of cutting encapsulated body 28 by supplying, to nozzle 11, water containing abrasive grains from one of the first tank 5 and the second tank 7 each filled with water containing abrasive grains, for example from the first tank 5. In FIG. 1, presence of flow is represented by the solid line and absence of the flow is represented by the broken line. Here, the first abrasive supply valve 19, the first return valve 22, the second abrasive supply valve 20, and the second return valve 23 are all closed. Further, high-pressure pump 2 is operated. Furthermore, nozzle 11 is aligned with respect to a predetermined position of encapsulated body 28 and the tip portion of nozzle 11 and the top surface of encapsulated body 28 are aligned with respect to each other so that the distance therebetween is a predetermined distance.

Switch valve 3 is used to open a flow channel from high-pressure pump 2 to the first inlet-side water pipe 4 and close a flow channel from high-pressure pump 2 to the second inlet-side water pipe 6. High-pressure pump 2 is used to supply water at a high pressure to the first tank 5 via the first inlet-side water pipe 4. The water supplied at a high pressure stirs the water containing abrasive grains in the first tank 5 so as to uniformly distribute abrasive grains and extrudes the water containing abrasive grains to supply the water containing abrasive grains to nozzle 11 at a high pressure via the first outlet-side water pipe 8 and nozzle pipe 10 successively. Thus, the water containing abrasive grains can be jetted at a high pressure from nozzle 1. High-pressure water 29 that is the water jetted at a high pressure and that is the water containing abrasive grains impinges against encapsulated body 28 fixed on fixing table 27. Accordingly, abrasive grains mainly contained in high-pressure water 29 impinge against encapsulated body 28. Further, in this state, nozzle 11 is moved at an appropriate speed in the horizontal (XY) direction to cut encapsulated body 28.

Subsequently, to nozzle 11 that is moving, water containing abrasive grains is supplied from the first tank 5, and high-pressure water 29 is jetted from nozzle 11 to cut encapsulated body 28. As this operation is repeated for a plurality of encapsulated bodies 28, the first tank 5 is continuously filled with water containing abrasive grains by the water injected at a high pressure from the first inlet-side water pipe 4. On the other hand, since abrasives are flown out of the first tank 5, the ratio of abrasive grains gradually decreases. The ratio as excessively decreased is not preferable since the cutting efficiency is considerably deteriorated.

In the case where the ratio in the first tank 5 becomes lower than a certain value, the use of the first tank 5 is relinquished and the second tank 7 is used instead. Specifically, control unit CNT determines, based on a signal received from the first sensor 25, that the ratio of abrasive grains in the first tank 5 is lower than a certain value and designates the first tank 5 as a tank that has to be replenished with abrasive grains. Control unit CNT uses switch valve 3 to close the flow channel from high-pressure pump 2 to the first inlet-side water pipe 4 and open the flow channel from high-pressure pump 2 to the second inlet-side water pipe 6. Thus, water containing abrasive grains is supplied from the second tank 7 to nozzle 11 via the second outlet-side water pipe 9 and nozzle pipe 10 successively so as to jet high-pressure water 29 from nozzle 11 and thereby cut encapsulated body 28.

Here, "a certain value" of the ratio described above is a value determined as a predetermined standard (reference value) and may be 5% by volume for example, preferably 10% by volume. The reason why "a certain value" of the ratio is set to 5% by volume is that, in the case where the ratio of abrasive grains is lower than 5% by volume, the cutting efficiency is considerably reduced. The reason why "a certain value" of the ratio may be 10% by volume is that a certain tolerance provided to the standard (reference value) is preferable in managing conditions under which the workpiece is cut.

Calculation of the ratio of abrasive grains in the first tank 5 is now described. The weight and capacity of the first tank 5 itself has been known. Further, the first tank 5 is substantially filled with water containing abrasive grains all the time. In addition, depending on the material of abrasive grains, the specific gravity of the abrasive grains is determined and thus the specific gravity is known. Therefore, in the following way, the ratio in the first tank 5 can be calculated by control unit CNT. The first sensor 25 is used to measure the weight of the first tank 5 filled with water containing abrasive grains. Then, from this weight, the weight of the first tank 5 filled with only the water (the weight may be calculated based on the capacity or actually measured) is subtracted. The resultant difference corresponds to the weight of the abrasive grains in the tank. The weight is divided by the specific gravity of the abrasive grains to determine the volume of the abrasive grains in the tank. Based on the volume thus determined of the abrasive grains and the capacity of the tank itself, the ratio in the first tank 5 can be calculated. Therefore, the first sensor 25 measures, as a substitute characteristic, the weight of the first tank 5 filled with water containing abrasive grains, which corresponds to detection of the ratio of abrasive grains in the first tank 5. A similar method to the above-described one may be applied to detection of the ratio in the second tank 7.

According to the foregoing description, the operation as described is performed in the case where the original ratio of abrasive grains in the water containing the abrasive grains that fills the first and second tanks 5, 7 each is high, namely the operation in the initial state. As one of the first and second tanks 5, 7 is continuously used and consequently the ratio of abrasive grains in that tank decreases, the use of that one tank is relinquished and the other tank is used instead. Then, the one tank with its use relinquished is replenished with abrasive grains.

Thirdly, with reference to FIG. 1, a description is given of an operation in the case where the use of one tank in which the ratio of abrasive grains decreases is relinquished and the other tank is to be used instead, specifically the operation of replenishing that one tank with abrasive grains. In FIG. 1, the other tank being used is the first tank 5 and the one tank replenished with abrasive grains after the use thereof is relinquished is the second tank 7.

In order to supply water containing abrasive grains to the second tank 7 with its use relinquished, the first abrasive supply valve 19 and the first return valve 22 are closed while the second return valve 23, the second abrasive supply valve 20 and water supply valve 24 are opened. Via water supply valve 24, abrasive supply pipe 18 and the second abrasive supply valve 20 successively, water is supplied at a predetermined pressure to the second tank 7. A resultant negative pressure causes high-ratio water to be sucked out from abrasive tank 16. The high-ratio water as sucked is injected together with the water to the second tank 7 via abrasive supply pipe 18 and the second abrasive supply valve 20 successively.

When the second tank 7 has been filled with water containing abrasive grains, water supply valve 24, the second abrasive supply vale 20 and the second return valve 23 are closed. In this state, the second tank 7 is on standby until the ratio in the first tank becomes lower than a certain value. The ratio in the water containing abrasive grains that fills the second tank 7 is determined by such factors as the ratio of abrasive grains in the high-ratio water and the pressure and quantity of water injected via water supply valve 24.

As described above, according to the present embodiment, the use of one tank in which the ratio of abrasive grains decreases is relinquished and the other tank is used instead. Accordingly, while one tank is replenished with abrasive grains, water containing abrasive grains can be supplied from the other tank to the nozzle for cutting. Therefore, the capacity utilization of the cutting apparatus is remarkably enhanced. Further, since water containing uniformly-distributed abrasive grains is supplied to the nozzle, wear of the nozzle and pipes is suppressed and the nozzle structure is simplified as compared with the case where dry abrasive grains or wet abrasive grains (abrasive) is used.

Second Embodiment

Figure 2:
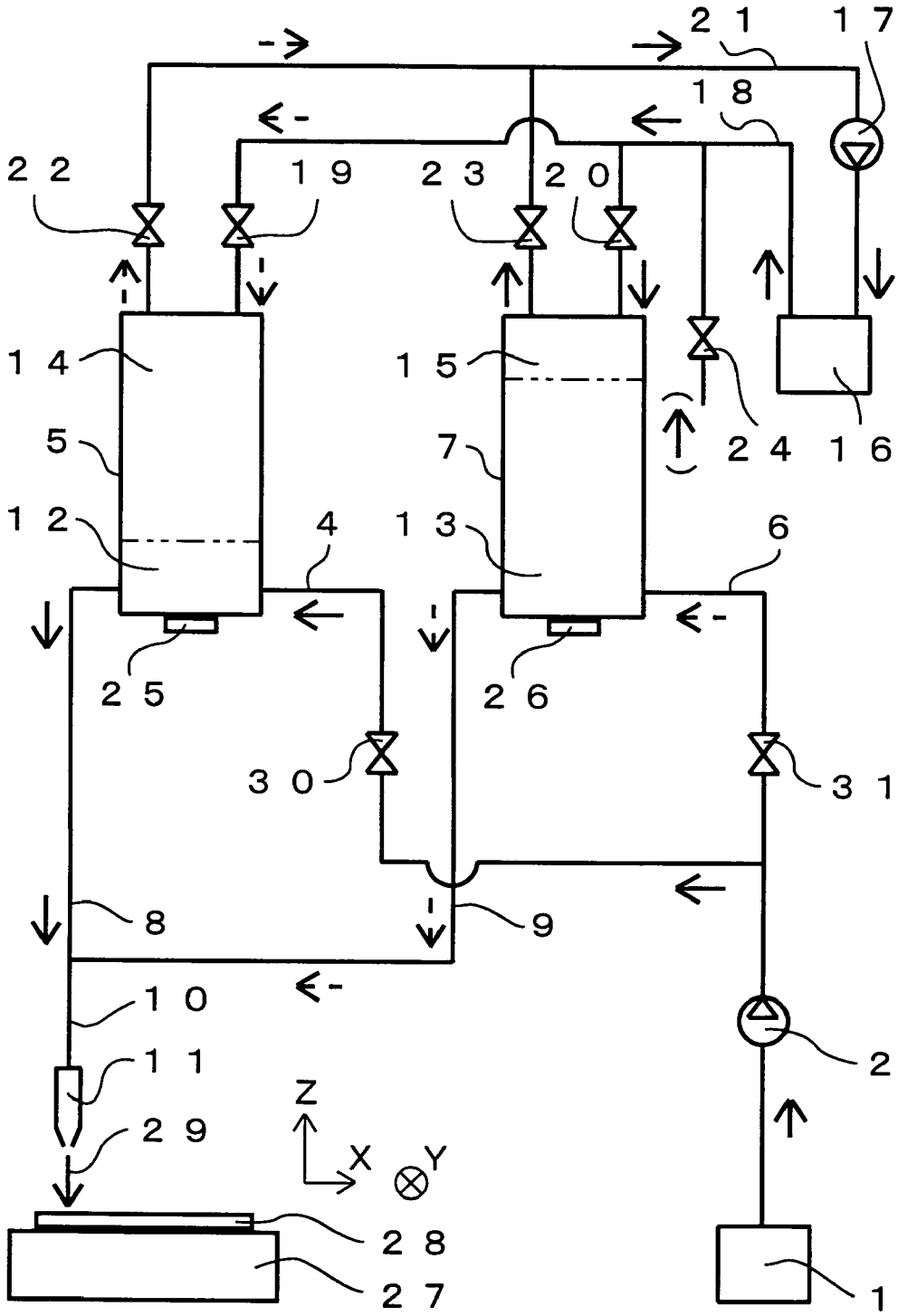

With reference to FIG. 2, a second embodiment of the cutting apparatus according to the present invention is described. FIG. 2 is a diagram of a pipe system, schematically showing a structure of the cutting apparatus according to the present embodiment. In any drawing referred to in the following description, the same component as that shown in FIG. 1 is denoted by the same reference character and the description thereof is not repeated.

In the cutting apparatus shown in FIG. 2, a first inlet-side open/close valve 30 is provided to the first inlet-side water pipe 4 and a second inlet-side open/close valve 31 is provided to the second inlet-side water pipe 6, instead of switch valve 3 in FIG. 1. With this cutting apparatus as well, effects similar to those of the cutting apparatus in the first embodiment can be obtained.

Third Embodiment

Figure 3:
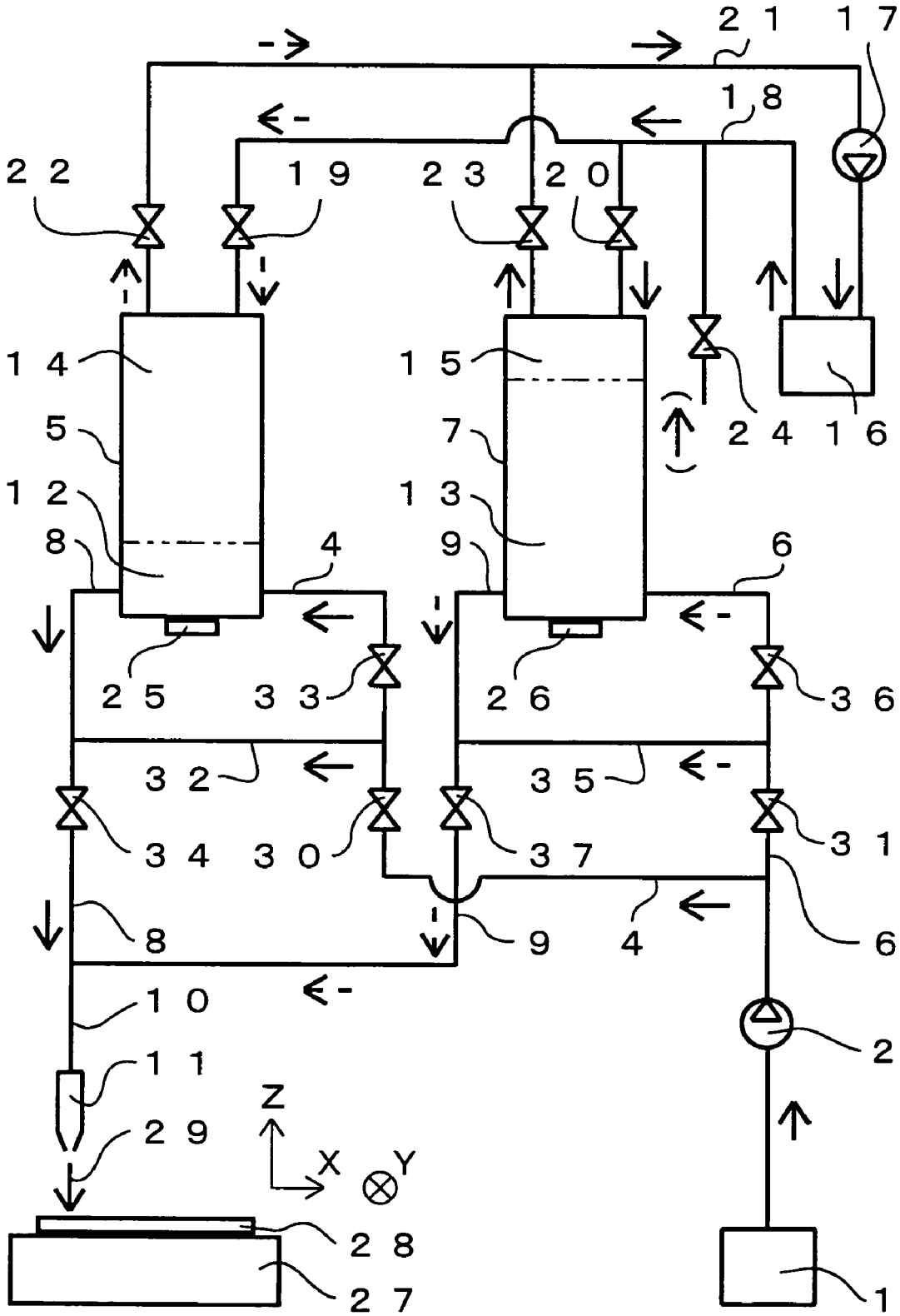

With reference to FIG. 3, a third embodiment of the cutting apparatus according to the present invention is described. FIG. 3 is a diagram of a pipe system, schematically showing a structure of the cutting apparatus according to the present embodiment. A feature of the cutting apparatus in the present embodiment is that a mechanism of preventing abrasive grains from remaining in pipes located downstream of the first tank 5 and the second tank 7 (the pipes include valves and nozzle 11 and are hereinafter referred to as "downstream-side pipe"). A pipe system associated with the first tank 5 is specifically described now. With the purpose of preventing abrasive grains from remaining in the downstream-side pipe, namely the pipe from the first outlet-side water pipe 8 to nozzle 11, a mechanism of supplying water containing no abrasive grain at a high pressure to the downstream-side pipe is provided. If abrasive grains remain in the downstream-side pipe, the resistance in the pipe increases. Thus, it is likely to occur that the downstream-side pipe is clogged with abrasive grains and thus the capacity utilization of the cutting apparatus could be deteriorated. In particular, in the case where a jet outlet and a small-diameter flow channel are small in diameter and small-diameter abrasive grains are used like the case where an encapsulated body in which semiconductor chips or the like mounted on a circuit board are encapsulated all together in resin is to be cut, clogging with abrasive grains is a serious problem. Therefore, in order to prevent such clogging, preferably the state where abrasive grains remain in the downstream-side pipes is avoided.

The cutting apparatus shown in FIG. 3 includes a system of supplying, at a high pressure, water containing no abrasive grain to the downstream-side pipe, and the system has the following components. The components associated with the first tank 5 are described below. The cutting apparatus includes, on the downstream side of the first inlet-side open/close valve 30, a first bypass pipe 32 connecting the first inlet-side water pipe 4 and the first outlet-side water pipe 8 without the first tank 5 therebetween. The cutting apparatus also includes a first tank open/close valve 33 provided to the first inlet-side water pipe 4 and between the first bypass pipe 32 and the first tank 5. The cutting apparatus includes a first outlet-side open/close valve 34 provided to the first outlet-side water pipe 8 and between the first bypass pipe 32 and the nozzle pipe 10. Similarly, the cutting apparatus includes a second bypass pipe 35, a second tank open/close valve 36 and a second outlet-side open/close valve 37 as components associated with the second tank 7. The positional relation between these components is similar to that between corresponding components of the first tank 5, and thus the description thereof is not repeated here.

In the following, a description is given of a method of cutting encapsulated body 28 that is a workpiece to be cut, using the cutting apparatus in FIG. 3. Firstly, an operation is described of cutting encapsulated body 28 by supplying water containing abrasive grains from the first tank 5 to nozzle 11.

In the present embodiment, the second outlet-side open/close valve 37, the second tank open/close valve 36 and the second inlet-side open/close valve 31 are all closed while the first outlet-side open/close valve 34, the first tank open/close valve 33 and the first inlet-side open/close valve 30 are opened. Accordingly, water injected at a high pressure from the first inlet-side water pipe 4 into the first tank 5 stirs water containing abrasive grains in the first tank 5 and thereby causes abrasive grains to distribute uniformly and extrudes the water containing abrasive grains into the first outlet-side water pipe 8. Further, water containing no abrasive grain is supplied at a high pressure to the first outlet-side water pipe 8 via the first bypass pipe 32. A resultant negative pressure allows water containing abrasive grains to be sucked out from the first tank 5. Thus, via the first outlet-side water pipe 8 and nozzle pipe 10 successively, water containing abrasive grains can be supplied to nozzle 11 at a high pressure. Thus, water containing abrasive grains can be jetted at a high pressure from nozzle 11.

Secondly, an operation of supplying, at a high pressure, water containing no abrasive grain to the downstream-side pipe associated with the first tank 5 is described. This operation has to be performed with the purpose of preventing abrasive grains from remaining in the downstream-side pipe, in the case where the operation of cutting encapsulated body 28 is temporarily stopped.

In this case, the first outlet-side open/close valve 34, the first tank open/close valve 33 and the first inlet-side open/close valve 30 are all opened while the first tank open/close valve 33 is closed in the state where high-pressure pump 2 is operating. Accordingly, from nozzle 11, water containing no abrasive grain can be jetted at a high pressure via the first inlet-side open/close valve 30, the first bypass pipe 32, the first outlet-side water pipe 8, the first outlet-side open/close valve 34, and nozzle pipe 10. Thus, abrasive grains remaining in the downstream-side pipe comprised of the first outlet-side water pipe 8, the first outlet-side open/close valve 34, nozzle pipe 10, and nozzle 11 are emitted together with the high-pressure water from nozzle 11. The operation as heretofore described prevents clogging of the downstream-side pipe with abrasive grains and thus the capacity utilization of the cutting apparatus is improved.

As heretofore described, according to the present embodiment, the mechanism of supplying water containing no abrasive grain to the downstream-side pipe is provided. Thus, remaining of abrasive grains in the downstream-side pipe is suppressed. Accordingly, clogging of the downstream-side pipe with abrasive grains is prevented and the capacity utilization of the cutting apparatus is improved.

It is noted that the configuration of valves shown in FIG. 3 in the present embodiment is an exemplary one. For example, a configuration of the following modification may be employed. According to this modification, instead of the first inlet-side open/close valve 30, a bypass valve is provided to the first bypass pipe 32. The bypass valve is closed while the first outlet-side open/close valve 34 and the first tank open/close valve 33 are both opened. Accordingly, an operation similar to that of the cutting apparatus in FIG. 2 is carried out. Further, in the case where water containing no abrasive grain is supplied at a high pressure to the downstream-side pipe, the first tank open/close valve 33 may be closed while the first outlet-side open/close valve 34 and the bypass valve may be opened.

Fourth Embodiment

Figure 4:
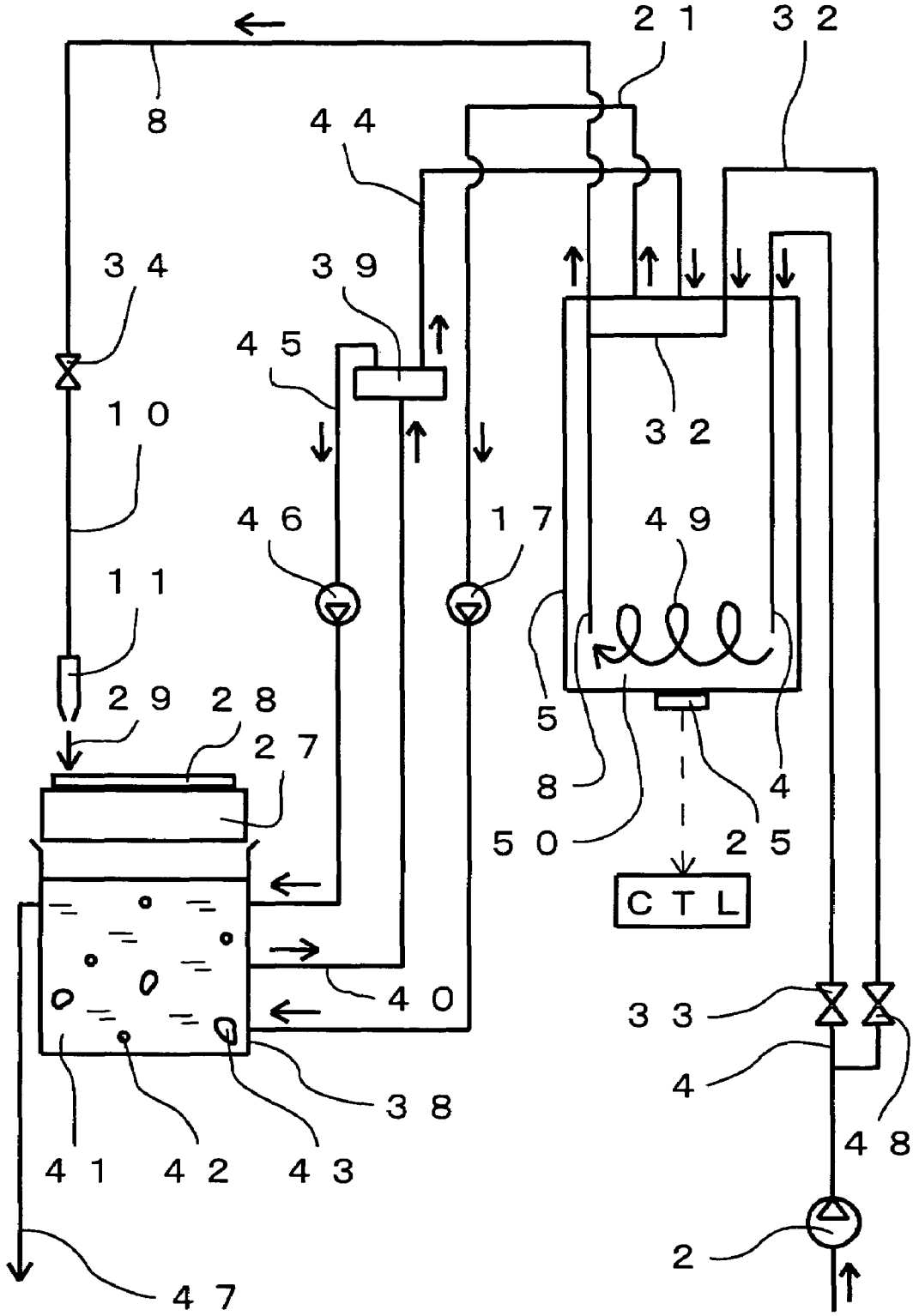

With reference to FIG. 4, a fourth embodiment of the cutting apparatus according to the present invention is described. FIG. 4 is a diagram of a pipe system, schematically showing a structure of the cutting apparatus according to the present embodiment. In FIG. 4, only the first tank 5 is shown for the sake of simplifying the description. A feature of the cutting apparatus in the present embodiment is that a tank is provided for holding water that is water containing abrasive grains and that has been used for cutting a workpiece and thereby collecting the abrasive grains, and this tank is also used as an abrasive tank (see abrasive tank 16 in FIGS. 1 to 3).

The cutting apparatus shown in FIG. 4 has a system for collecting water that contains abrasive grains and that has been used for cutting a workpiece, and the system includes a collection tank 38 provided below fixing table 27, a sieve 39 and a collection pipe 40 connecting collection tank 38 and sieve 39. Here, the water used for cutting and held in collection tank 38 includes water 41 itself, standard abrasive grains 42 comprised of abrasive grains having its grain size equal to or smaller than a predetermined value, and nonstandard particles 43 that are generated by the cutting and that have a particle size larger than the predetermined value.

The system used for collecting water as used further include a reuse pipe 44 supplying standard abrasive grains 42 to the first tank 5, a nonstandard particle pipe 45 providing nonstandard particles 43 back to collection tank 38, and a nonstandard particle pump 46 provided to nonstandard particle pipe 45. Further, a drainpipe 47 is provided to collection tank 38.

The cutting apparatus includes, as a component that is irrelevant to the system of collecting used water, a bypass valve 48 provided to the first bypass pipe 32. This bypass valve 48 corresponds to the bypass valve described above in connection with the modification of the third embodiment.

In the following, an operation of the cutting apparatus in FIG. 4 is described. First outlet-side open/close valve 34, the first tank open/close valve 33 and bypass valve 48 are all opened. Accordingly, water injected at a high pressure from the first inlet-side water pipe 4 to the first tank 5 generates a water stream 49 in the first tank 5. This water stream 49 stirs water 50 containing abrasive grains and thereby uniformly distributes abrasive grains, and also extrudes water 50 containing abrasive grains to the first outlet-side water pipe 8. Further, water containing no abrasive grain is supplied at a high pressure via the first bypass pipe 32 to the first outlet-side water pipe 8. A negative pressure thus generated causes water 50 containing abrasive grains to be sucked out from the first tank 5. By these functions, water 50 containing abrasive grains can be supplied at a high pressure to nozzle 11 via the first outlet-side water pipe 8 and nozzle pipe 10 successively. Thus, water 50 containing abrasive grains can be jetted at a high pressure from nozzle 11.

A description is given of an operation of holding water having been used for cutting and collecting abrasive grains in the cutting apparatus in FIG. 4. In an initial state, high-ratio water is supplied to collection tank 38. Thus, collection tank 38 also serves as an abrasive tank (see abrasive tank 16 in FIGS. 1 to 3) supplying high-ratio water to the first tank 5.

Then, water is injected at a high pressure from the first inlet-side water pipe 4 to the first tank 5. Accordingly, water 50 containing abrasive grains is jetted at a high pressure from nozzle 11 to cut encapsulated body 28. Water 50 containing abrasive grains and having been used for cutting is then held in collection tank 38. The water held in collection tank 38 is extruded by the pressurized water supplied by extrusion pump 17 to collection tank 38, and supplied via collection pipe 40 to sieve 39. Standard abrasive grains 42 sifted out by sieve 39 are returned together with water to the first tank 5 via reuse pipe 44. Nonstandard particles 43 sifted out by sieve 39 are returned together with water to collection tank 38 via nonstandard particle pipe 45 and nonstandard particle pump 46. Since nonstandard particles 43 cannot be used for cutting, when the amount of nonstandard particles 43 stored in collection tank 38 reaches a certain amount, these nonstandard particles 43 are discarded.

As described above, according to the present embodiment, standard abrasive grains 42 can be collected for using them again. Therefore, the running cost of the cutting apparatus can be reduced. Further, collection tank 38 and the abrasive tank for supplying high-ratio water to the first tank 5 can be provided as a common tank. Thus, the cutting apparatus can be simplified.

Fifth Embodiment

Figure 5:
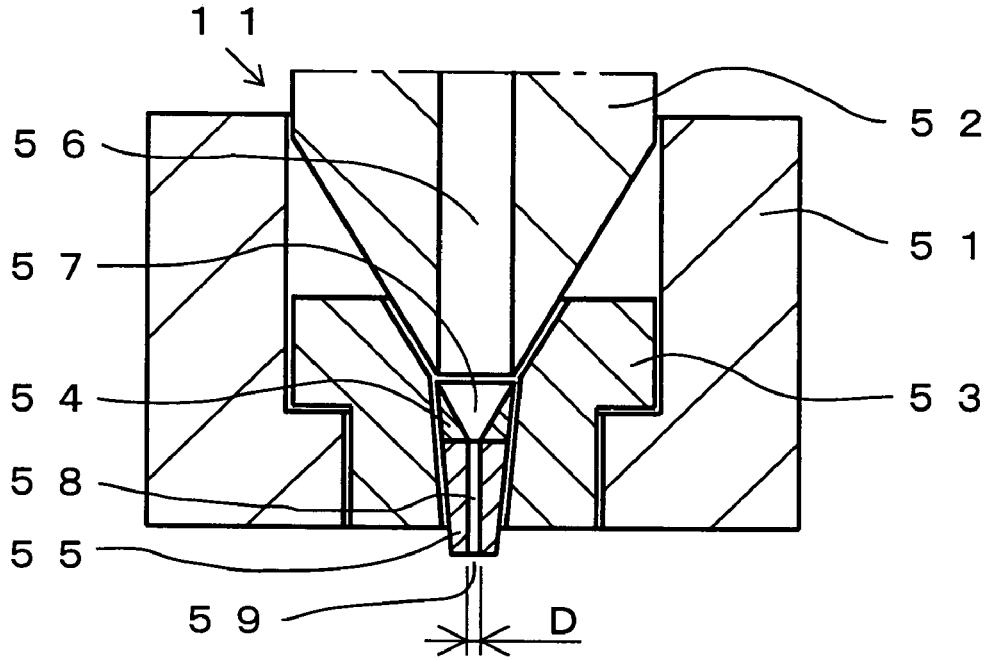
FIG. 5 is a partial cross-sectional view showing a main portion of a nozzle used for a cutting apparatus according to a fifth embodiment of the present invention.

With reference to FIG. 5, a description is given of a nozzle for cutting that is used in a fifth embodiment of the cutting apparatus according to the present invention. FIG. 5 is a partial cross-sectional view showing a main portion of the nozzle in an enlarged state that is used for the cutting apparatus according to the present embodiment, and FIG. 6 is a partial cross-sectional view showing, in a further enlarged state, a tip portion of the nozzle.

As shown in FIG. 5, nozzle 11 for cutting has a holder 51, a columnar body 52 fixed inside holder 51, a support body 53 fitted in the leading end of columnar body 52 within holder 51, a coupling body 54 and a nozzle tip 55 fitted together in support body 53. In columnar body 52, a flow channel 56 having a predetermined diameter is provided. Coupling body 54 is connected to flow passage 56 and has a space 57 in the shape of a funnel that tapers. In nozzle tip 55, a small-diameter flow channel 58 connected to space 57 and having a certain diameter D is provided. The leading end of nozzle tip 55 protrudes by a predetermined extent from the leading end of support body 53 and holder 51, and the leading end of small-diameter flow channel 58 forms a jet outlet 59 formed of an opening having the diameter D. Here, holder 51, columnar body 52, support body 53, coupling body 54 and nozzle tip 55 are made for example of stainless steel, ceramic material or the like. On the internal wall of small-diameter flow channel 58 of nozzle tip 55, a wear-resistant film 60 is formed. Wear-resistant film 60 is formed by such a well-known method as plasma CVD.

Figure 6:
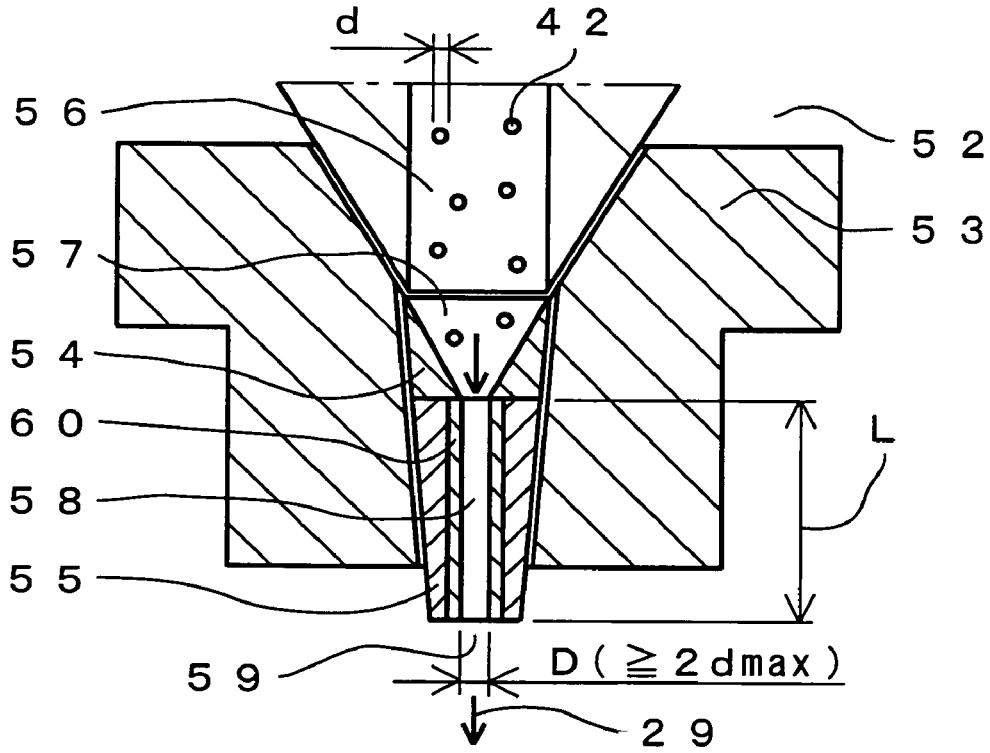
FIG. 6 is a partial cross-sectional view showing, in an enlarged state, a tip portion of the nozzle in FIG. 5.

Nozzle 11 shown in FIGS. 5 and 6 has a first feature that wear-resistant film 60 formed on the internal wall of small-diameter flow channel 58 is made of a wear-resistant material that is for example single crystal diamond, single crystal sapphire, sintered diamond, sintered cubic boron nitride (cBN), or a composite material in which diamond or cNB is dispersed in cemented carbide. Accordingly, even if water pressurized at a high pressure and containing abrasive grains 42 is flown at a high speed in small-diameter flow channel 58, wear of the inner wall of small-diameter flow channel is reduced.

Nozzle 11 shown in FIGS. 5 and 6 has a second feature that the diameter D of small-diameter flow channel 58 is determined in the following way with respect to the diameter d of abrasive grain 42. Specifically, the relation between the maximum value dmax that is one of standards defined for the diameter d of abrasive grains 42 and the diameter D of small-diameter flow passage 58 is defined as D≧2dmax. The reason why the relation is thus defined is as follows. It is empirically known that, in the case where the diameter D of small-diameter flow channel 58 is smaller than twice the maximum value dmax allowed as the diameter d of abrasive grains 42, small-diameter flow channel 58 or jet outlet 59 is likely to be clogged with abrasive grains 42. Clogging of small-diameter flow channel 58 or jet outlet 59 with abrasive grains 42 is thus prevented and accordingly the capacity utilization of the cutting apparatus is improved. In the case where an encapsulated body (see encapsulated body 28 in FIGS. 1 to 4) is cut, the diameter d=63 μm of abrasive grains 42, the maximum value dmax=100 μm of the standard diameter and the diameter D=250 μm of small-diameter flow channel 58 are employed.

Here, the upper limit value of the diameter D of small-diameter flow channel 58 with respect to the diameter d of abrasive grains 42 is not particularly defined for the following reason. In the case where a desired cutting width is large, the diameter D of the small-diameter flow channel has to be increased as required and therefore, it is preferable that the upper limit value of the diameter D is not limited to a particular value. According to the large cutting width, the diameter D of the small-diameter flow channel may be increased to cut a workpiece with the large cutting width.

Nozzle 11 shown in FIGS. 5 and 6 has a third feature that the relation between the length L and the diameter D of small-diameter flow channel 58 is defined as 2D≦L≦20D. Between the length L and the diameter D of small-diameter flow channel 58, there is the following relation. In the case where the relation is 2D>L, high-pressure water 29 jetted from jet outlet 59 spreads, resulting in problems that the cutting efficiency deteriorates and the cutting width increases. In this case, the length of wear-resistant film 60 (distance in the up-and-down direction in the drawing) is small, resulting in the problem that the lifetime of nozzle tip 55 shortens. In the case where the relation is L>20 D, a problem is that small-diameter flow channel 58 is likely to be clogged with abrasive grains 42. Further, in this case, a pressure loss in small-diameter flow channel 58 occurs, which results in a problem of reduced cutting efficiency. In view of these factors, the length L is defined with respect to the diameter D, as 2D≦L≦20D. In the case where an encapsulated body (see encapsulated body 28 in FIGS. 1 to 4) is to be cut, preferably the relation between the length L and the diameter D of the small-diameter flow channel is defined as 10D≦L≦20D. Specifically, for small-diameter flow channel 58, the employed dimensions are diameter D=250 μm and length L=4.7 mm.

Nozzle 11 shown in FIGS. 5 and 6 has a fourth feature that funnel-like tapering space 57 that connects to flow channel 56 is provided to coupling body 54, and the leading end of the tapering portion connects to small-diameter flow channel 58. In other words, the fourth feature is that funnel-like space 57 which connects flow channel 56 and small-diameter flow channel 58 and which tapers toward small-diameter flow channel 58 is provided. Thus, in the pipe extending from flow channel 56 to small-diameter flow channel 58, water pressurized at a high pressure and containing abrasive grains 42 can flow without being subjected to a large resistance.

As discussed above, according to the present embodiment, since wear-resistant film 60 is formed on the inner wall of small-diameter flow channel 58, wear of the inner wall is reduced. Therefore, nozzle tip 55 has an extended lifetime and thus any work necessary for management and maintenance of the cutting apparatus is reduced. Further, since the diameter D of small-diameter flow channel 58 is defined appropriately with respect to the diameter d of abrasive grains 42, clogging of small-diameter flow channel 58 or jet outlet 59 with abrasive grains 42 is prevented. Further, since the length L of small-diameter flow channel 58 is defined appropriately with respect to the diameter D thereof, clogging of small-diameter flow channel 58 with abrasive grains 42 is suppressed without shortening the lifetime of nozzle chip 55, and the cutting efficiency is kept at appropriate efficiency. Further, since space 57 that tapers from flow channel 56 toward small-diameter flow channel 58 is provided, water containing abrasive grains 42 flows without being subjected to a large resistance.

In the present embodiment, the member itself where small-diameter flow channel 58 is formed, namely nozzle chip 55 itself may be made of a wear-resistant material of sintered diamond for example. In this case as well, the inner wall of small-diameter flow channel 58 is formed of the wear-resistant material and thus wear of the inner wall of small-diameter flow channel 58 is reduced.

Sixth Embodiment

Figure 7:
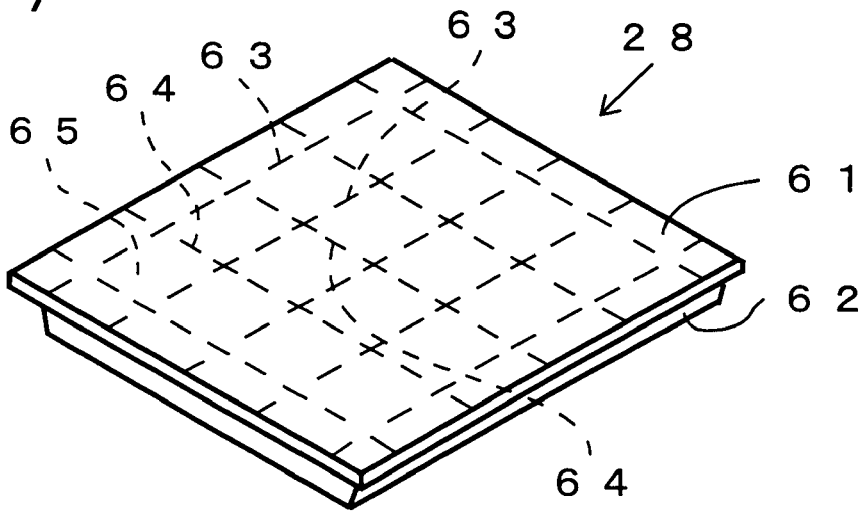
FIG. 7 is a perspective view schematically showing a structure of an encapsulated body used for a cutting apparatus according to a sixth embodiment of the present invention.
Figure 8:
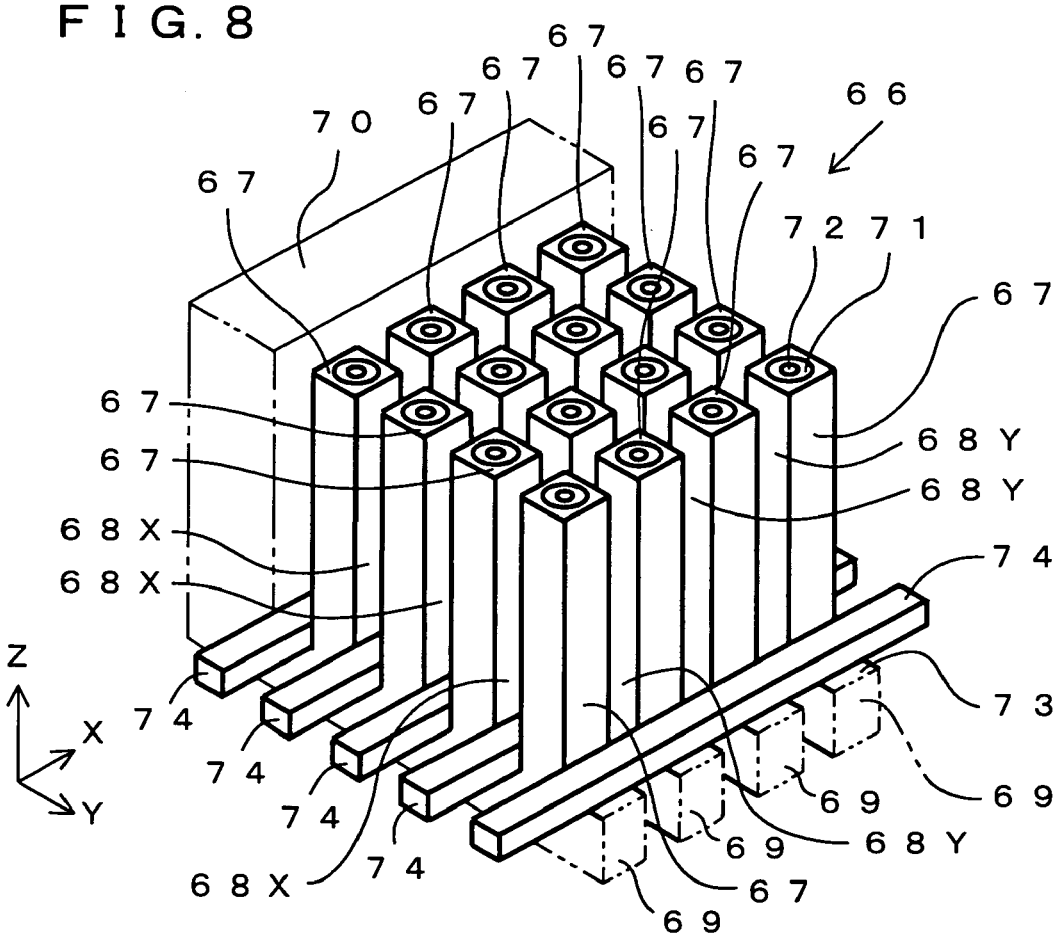
FIG. 8 is a perspective view schematically showing a structure of a fixing table used for the cutting apparatus according to the sixth embodiment of the present invention.
Figure 9:
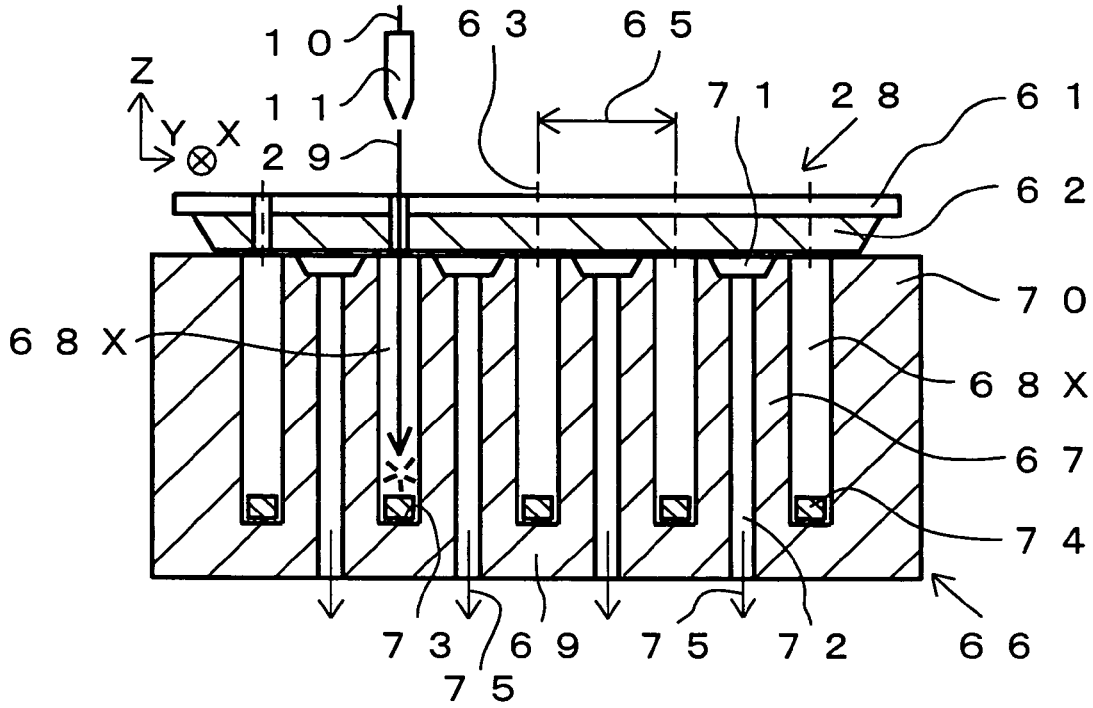
FIG. 9 shows a cross section in the Y direction of protruded portions of the fixing table in FIG. 8.
Figure 10:
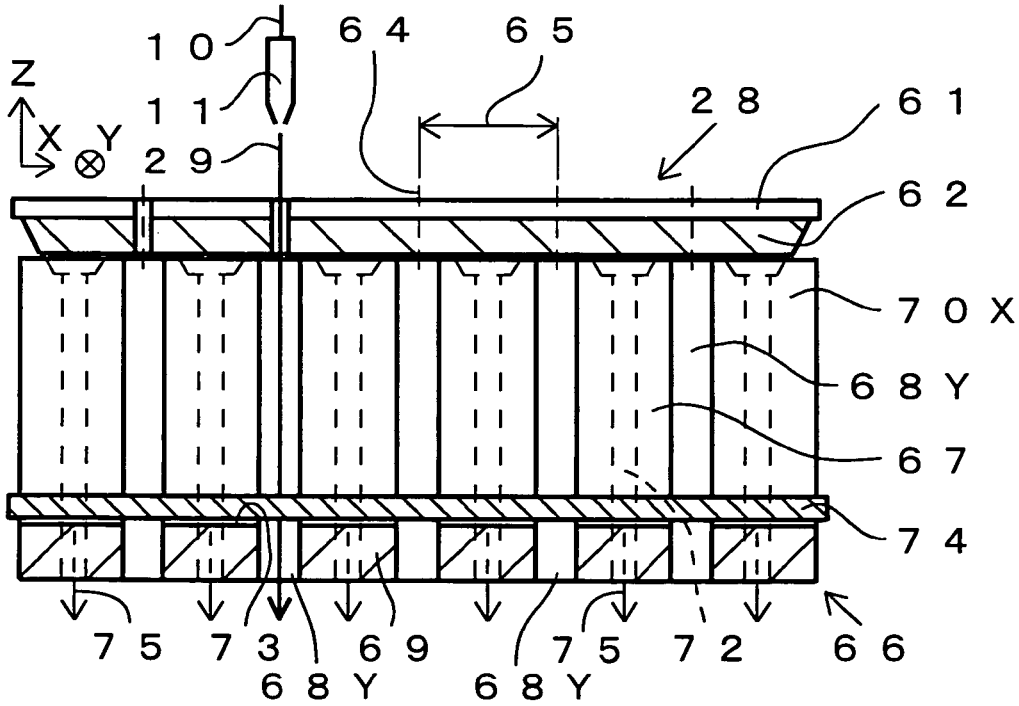
FIG. 10 shows a cross section in the X direction of grooves of the fixing table in FIG. 8.

With reference to FIGS. 7 to 10, a description is given of a fixing table that is a receiving mechanism used for the cutting apparatus according to a sixth embodiment of the present invention. FIGS. 7 and 8 are perspective views schematically showing a structure of the fixing table as well as an encapsulated body used for the cutting apparatus in the present embodiment. FIG. 9 shows a cross section in the Y direction of protruded portions of the fixing table in FIG. 8, and FIG. 10 shows a cross section in the X direction of groove portions of the fixing table in FIG. 8.

As shown in FIG. 7, encapsulated body 28 that is a workpiece to be cut has a circuit board 61 such as leadframe or printed circuit board as well as an encapsulating resin 62. Cutting lines 63 and 64 that intersect at right angles are provided as virtual lines. Regions 65 into which the whole region is partitioned by these cutting lines 63, 64 each correspond to a package of an electronic component that is a completed product.

As shown in FIG. 8, fixing table 66 used for the present embodiment has the following components. Fixing table 66 includes protruded portions 67 provided correspondingly to respective regions 65 of encapsulated body 28 as well as groove portions 68X, 68Y provided between protruded portions 67 in the X direction and the Y direction respectively. Further, fixing table 66 includes support portions 69 provided to connect respective lower portions of protruded portions 67 in the Y direction as well as a frame portion 70 (partially shown) provided to connect support portions 69 at both ends of each support portion 69. Thus, groove portions 68X are periodically closed at respective lower portions by support portions 69. Groove portions 68Y extend through fixing table 66. In FIG. 8, only a part of frame portion 70 is shown. However, actually the frame portion is provided to enclose the four side surfaces of fixing table 66. Frame portion 70 prevents water that has been used and that contains abrasive grains from scattering.

At protruded portions 67 each and at frame 70 as required, recesses 71 are provided in the top surface and through holes 72 are provided each at a central portion of recess 71. Through holes 72 are connected by a pipe to a suction mechanism (both are not shown). Of groove portions 68X, 68Y, groove portions extending in one direction, for example, groove portions 68X extending in the X direction are provided with protection members 74 each formed of a thin plate-like member to cover respective top surfaces 73 of support portions 69. Protection members 74 are attachable to and detachable from groove portions 68X and made of a material having a higher hardness than that of abrasive grains used for cutting. As such a material, single crystal diamond, single crystal sapphire, sintered diamond, sintered cubic boron nitride (cBN), or a composite material in which diamond or cBN is dispersed in cemented carbide, for example, may be used.

With reference to FIGS. 7 to 10, a function of protection members 74 when encapsulated body 28 is cut is described. First, encapsulated body 28 is drawn by suction air 75 via through holes 72 and recesses 71 successively and thereby secured to fixing table 66, more accurately to protruded portions 67 and a part of frame portion 70.

Next, a description is given of the case where encapsulated body 28 is cut in the X direction. In this case, as shown in FIG. 9, while high-pressure water 29 containing abrasive grains and having been used for cutting impinges against protection members 74 in all of groove portions 68X, it does not impinge against top surface 73 of support portion 69. Wear of support portion 69 of fixing table 66 is thus prevented.

Next, a description is given of the case where encapsulated body 28 is cut in the Y direction. In this case, the same fixing table 66 may be used and the direction in which nozzle 11 is moved may be changed to cut encapsulated body 28. As shown in FIG. 10, high-pressure water 29 having been used for cutting flows as follows. In a region where groove portion 68Y is located between protruded portions 67, high-pressure water 29 passes through groove portion 68Y to any region below fixing table 66. Therefore, high-pressure water 29 does not impinge at all against fixing table 66. In a region where groove portion 68Y intersects groove portion 68X, high-pressure water 29 impinges against protection member 74 and does not impinge against top surface 73 of support portion 69, like the above-described case where encapsulated body 28 is cut in the X direction. Accordingly, in the case where encapsulated body 28 is cut in the X direction and the Y direction by using the same fixing table 66, wear of fixing table 66 is prevented. In the case where encapsulated body 28 is cut successively, protection members 74 gradually wear. In this case, protection members 74 may be replaced as required. Thus, encapsulated body 28 can be cut without wear of fixing table 66.

As described above, according to the present embodiment, the same fixing table 66 can be used to cut encapsulated body 28 in the X direction and the Y direction. In other words, in the case where encapsulated body 28 is cut in the X direction and the Y direction, it is unnecessary to prepare two types of fixing tables 66, to replace fixing table 66 and to align encapsulated body 28. Therefore, in the case where encapsulated body 28 is cut along cutting lines in two intersecting directions, the cost for fixing table 66 is reduced and deterioration in working efficiency and in dimensional accuracy (position, angle for example) in cutting are prevented.

Figure 11:
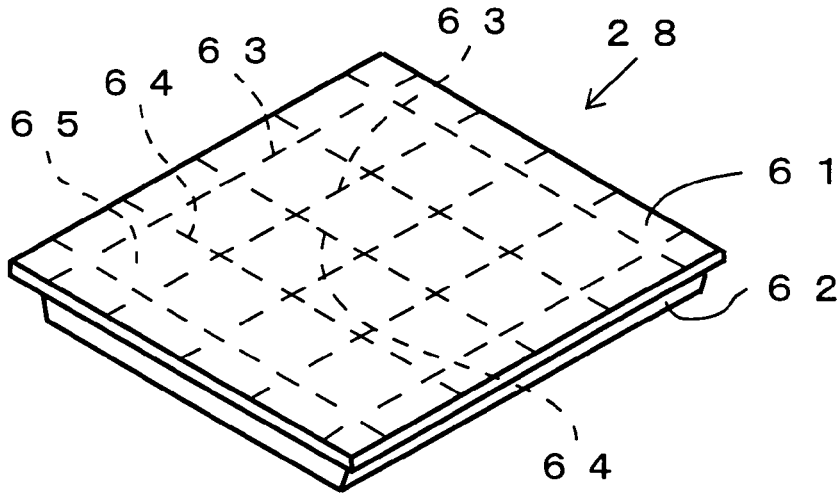
FIG. 11 is a perspective view schematically showing a structure of an encapsulated body used for a modification of the cutting apparatus according to the sixth embodiment of the present invention.
Figure 12:
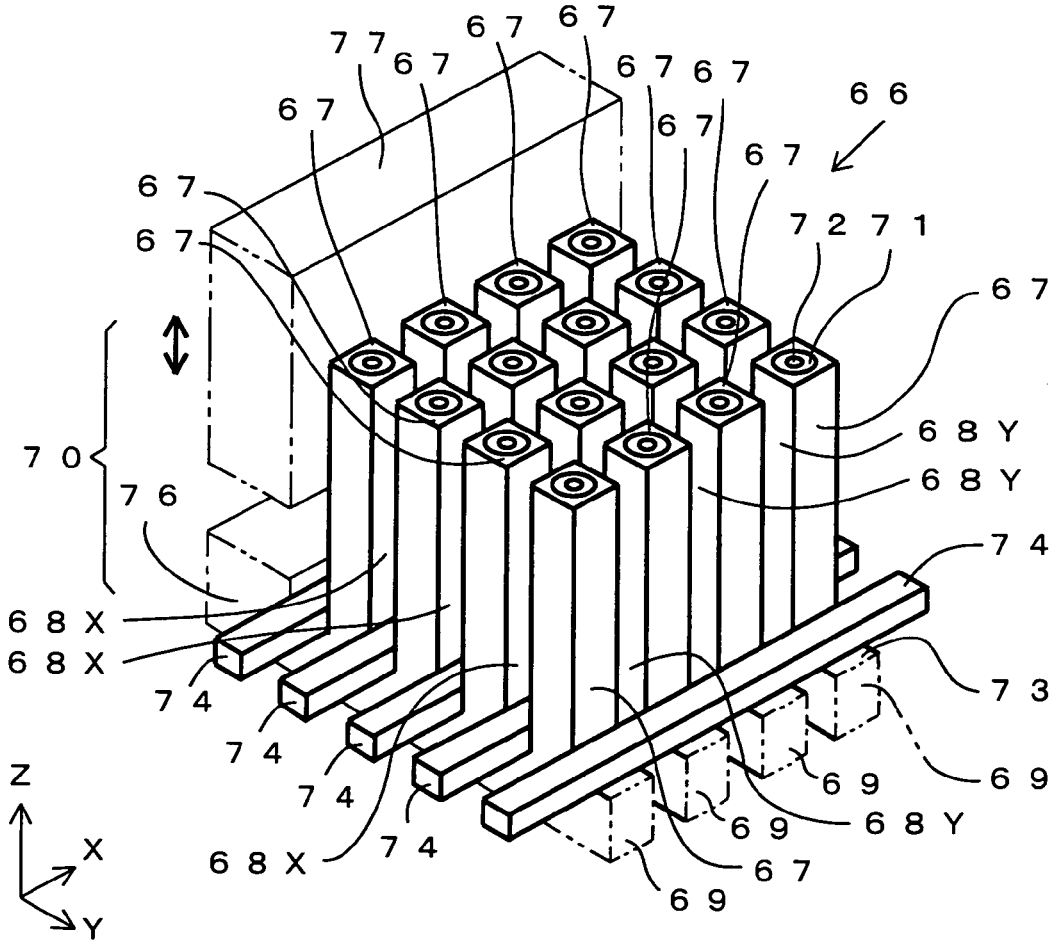
FIG. 12 is a perspective view schematically showing a structure of a fixing table used for the modification of the cutting apparatus according to the sixth embodiment of the present invention.

A modification of the cutting apparatus according to the present embodiment is hereinafter described with reference to FIGS. 11 and 12. FIGS. 11 and 12 are perspective views schematically showing a structure of a fixing table and an encapsulated body used for the modification of the cutting apparatus according to the present embodiment. A feature of the modification is that frame portion 70 shown in FIGS. 9 and 10 is formed of two attachable and detachable members in this modification. Specifically, the two members are a lower frame portion 76 and a wall member 77 shown in FIG. 12. In this modification, when protection member 74 is replaced, wall member 77 is detached in the upward direction (Z direction) as seen in the drawing. Further, wall member 77 provided attachably and detachably to fixing table 66 and provided on the outer periphery of fixing table 66 prevents water used for cutting and containing abrasive grains from scattering. In the present embodiment, since processing of fixing table 66 as a whole is simplified as compared with the structure shown in FIG. 7, fixing table 66 can be reduced in price. Moreover, such operations as insertion and fitting of protection member 74 into and in groove portion 68X are facilitated.

In the description of the present embodiment (including the modification), protection member 74 is made of a material having a higher hardness than that of abrasive grains used for cutting. The material, however, is not limited to this. Protection member 74 may be made of a material having a lower hardness than that of abrasive grains. Examples of such a material include such a metal material as stainless steel, such a resin material as urethane resin and such a ceramic material as alumina. These materials are inferior in wear resistance to such a material as sintered diamond described above in connection with the embodiment. Thus, protection member 74 made of any of these materials wears in a shorter time as compared with protection member 74 made of such a material as sintered diamond. However, protection member 74 of lower hardness is available at a lower price. Therefore, depending on the type of abrasive grains and cutting conditions, lower-hardness protection member 74 may be used by replacement. What is important here is that water containing abrasive grains impinges against protection member 74 and thus the water containing abrasive grains does not impinge against support portion 69.

Further, attachable and detachable protection members 74 are inserted respectively to groove portions 68X for use. Alternatively, attachable and detachable protection members 74 connected on one end like a comb may be inserted into groove portions 68X. Still alternatively, attachable and detachable protection members 74 in the shape of a double cross (pound sign or symbol #) may be inserted into groove portions 68X, 68Y for use. The collective protection members in those shapes as described above can be produced for example by etching a metal material.

Protection members 74 may be provided along both of two different directions (X direction and Y direction in FIGS. 7 to 12) of cutting lines 63, 64 in a grid pattern. In this case, all protruded portions 67 are connected at support portions 69, and respective top surfaces 73 of support portions 69 are all covered with the protection members extending in the X direction and the Y direction or with the protection members in the form of a double cross (symbol #). Therefore, it does not occur that high-pressure water impinges against top surface 73 of support portion 69 and accordingly support portions 69 are prevented from wearing.

Cutting lines 63, 64 extending in two intersecting directions of encapsulated body 28 that is a workpiece to be cut may be lines intersecting at right angles in a grid pattern as shown in FIGS. 7, 8, 11 and 12 or may be lines that do not intersect at right angles. Further, two cutting lines 63, 64 may be a combination of a curved line and a straight line or a combination of curved lines. Any of the above-described cutting lines may be employed as long as groove portions 68X, 68Y are provided that are located below cutting lines 63, 64 extending in respective directions and that include actual cutting portions respectively and protection members 74 are provided in respective groove portions 68X, 68Y to cover support portions 69. In this way, the advantages of waterjet cutting along a curved cutting line can fully be exhibited.

In connection with the embodiments heretofore described, the case is described where an encapsulated body in which semiconductor chips or the like mounted on a circuit board are encapsulated all together in resin is cut along cutting lines intersecting at right angles in a grid pattern. The present invention, however, is not limited to this and is applicable to the case where other workpieces are to be cut. In addition, the present invention may be applied not only for the purpose of completing a product but also for the purpose of disassembling any unnecessary object for discarding it.

Further, the water containing abrasive grains may contain other materials for any purpose. These other materials include for example cleaning agent.

The ratio of abrasive grains to water containing the abrasive grains is detected by using a sensor for measuring the weight. The ratio may alternatively be detected by using a sensor of any of other types detecting a characteristic except for the weight. Such a sensor includes a sensor detecting the ratio of abrasive grains in each tank based on such characteristics as optical characteristics of the water containing abrasive grains (amount of transmitted light, amount of scattering light, amount of reflected light for example), chemical characteristics (pH for example), electrical characteristics (electrical conductivity for example), and acoustic characteristics (attenuation of ultrasonic waves for example).

As a group of tanks comprised of a plurality of tanks storing water containing abrasive grains, two tanks that are the first tank 5 and the second tank 7 are provided. The present invention, however, is not limited to this and may have a tank group comprised of at least N tanks (N is an integer satisfying $N \geqq 3$) and a part of the tanks, namely one to (N−1) tanks may be designated as a supply tank or supply tanks.

In the case where a part of the tanks is designated as a supply tank or supply tanks, the tank(s) is (are) designated based on the ratio of abrasive grains in each tank. The present invention, however, is not limited to this. Specifically, a certain tank may be used as a supply tank and, after a certain time, another tank may be designated as a supply tank. In this case, a tank is replenished with abrasive grains as follows. First, the quantity of water (including abrasive grains) flowing out of a supply tank in the aforementioned certain time is detected or calculated. Next, based on this quantity, the quantity of abrasive grains flowing out of the supply tank is calculated. Then, a quantity of abrasive grains corresponding to the calculated quantity of abrasive grains is supplied to the tank that has been used as a supply tank and needs replenishment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cutting apparatus jetting, at a high pressure, water containing abrasive grains from a nozzle so as to cut a workpiece along cutting lines extending in two intersecting directions, comprising:

a fixing table fixing said workpiece;

groove portions provided in said fixing table at respective positions below said cutting lines;

protruded portions provided in respective regions of said fixing table other than regions where said groove portions are provided, in a manner that said workpiece contacts said protruded portions;

support portions provided to connect said protruded portions substantially in parallel with a cutting line extending in at least one of said two directions along said groove portions;

a frame portion provided to connect said support portions to each other in at least a part of an outer periphery of said fixing table; and protection members attachably and detachably provided to cover said support portions, said protection members provided for the purpose of allowing said water containing abrasive grains to impinge against the protection members and thereby preventing said water containing abrasive grains from impinging against said support portions.

2. The cutting apparatus according to claim 1, wherein said protection members are made of a material higher in hardness than said abrasive grains.

3. The cutting apparatus according to claim 1, further comprising a wall member provided at the outer periphery of said fixing table for the purpose of preventing scattering of said water containing abrasive grains, wherein said wall member is attachable to and detachable from said fixing table and said protection members are inserted to said groove portions in a state where said wall member is detached.

* * * * *